US005474292A

United States Patent [19]

Anghelo et al.

[11] Patent Number: 5,474,292

[45] Date of Patent: Dec. 12, 1995

[54] PINBALL GAME BALL DIVERTER MECHANISM

[75] Inventors: Python V. Anghelo, Chicago; Robert S. Morrison, Elgin, both of Ill.

[73] Assignee: Gamestar, Inc., Arlington Heights, Ill.

[21] Appl. No.: 393,342

[22] Filed: Feb. 28, 1995

[51] Int. Cl.[6] ..... A63F 7/02; A63F 7/30

[52] U.S. Cl. ..... 273/118 R; 273/121 A; 273/121 R; 273/118 A; 273/127 R

[58] Field of Search ..... 273/118–121, 127 R, 273/127 B, 127 C, 129 R

[56] References Cited

U.S. PATENT DOCUMENTS 4,981,298 1/1991 Lawlor et al. .
5,002,279 3/1991 Kaminkow et al. ..... 273/121 A X
5,226,653 7/1993 Bil et al. ..... 273/121 A
5,358,240 10/1994 Lawlor et al. .

*Primary Examiner*—Raleigh W. Chiu
*Attorney, Agent, or Firm*—Robert E. Browne; Gary R. Jarosik

[57] ABSTRACT

A ball diverter mechanism for use in directing a ball in a pinball game having an entry path and first and second exit paths. The ball diverter mechanism comprises a solenoid having a plunger movable between a first position wherein the plunger is extended and a second position wherein the plunger is retracted, a first ball contacting surface linked to the plunger, and a second ball contacting surface also linked to the plunger. When the plunger is in the first position, the ball will engage the first ball contacting surface and travel under the second ball contacting surface to cause the ball to be diverted from the entry path to the first exit path. When the plunger is in the second position, the ball will engage the second ball contacting surface and travel over the first ball contacting surface to cause the ball to be diverted from the entry path into the second exit path.

5 Claims, 2 Drawing Sheets

PINBALL GAME BALL DIVERTER MECHANISM

BACKGROUND OF THE INVENTION

This invention relates generally to amusement games and, more particularly, relates to a ball diverter mechanism for use in directing a ball in a pinball game.

In the prior art it is known to divert a ball between two paths in a pinball game from an entry path. These prior art diverters are typically constructed with a single gate rotatable between a first position and a second position. When the gate is positioned in the first position the ball avoids contact with the gate and is free to travel down the first path which is typically aligned with the entry path. If the gate is positioned in the second position the gate blocks access to the first path and the ball is thereby directed by contact with the gate towards the second path which is generally offset from the entry path. Typically, a solenoid is used to move the gate between the two positions wherein the solenoid is activated to cause the gate to rotate from the first position to the second position. There is also known ball diverters of the type wherein the gate is used to divert a ball between two paths which are both offset from the entry path. In this type of ball diverter a pair of solenoids are typically used to cause rotation of the gate between the two positions wherein the ball is directed by contact with the gate to either the first or second path. A need exists, however, for a single solenoid activated ball diverter capable of directing a ball between two offset paths.

As a result of this existing need, it is an object of the present invention to provide an improved pinball game ball diverter mechanism which requires less space than those ball diverts currently used.

It is a further object of the present invention to provide a pinball game ball diverter mechanism which utilizes a single solenoid for use in directing the ball between two paths.

SUMMARY OF THE INVENTION

In accordance with the present invention, a ball diverter mechanism is provided for use in directing a ball in a pinball game having an entry path and first and second exit paths. The ball diverter mechanism includes a solenoid having a plunger movable between a first position wherein the plunger is extended and a second position wherein the plunger is retracted, a first ball contacting surface linked to the plunger, and a second ball contacting surface also linked to the plunger. When the plunger is in the first position, the ball will engage the first ball contacting surface and travel under the second contacting surface to cause the ball to be diverted from the entry path to the first exit path. When the plunger is in the second position, the ball will engage the second ball contacting surface and travel over the first ball contacting surface to cause the ball to be diverted from the entry path into the second exit path.

A better understanding of the objects, advantages, features, properties and relationships of the invention will be obtained from the following detailed description and accompanying drawings which set forth an illustrative embodiment and is indicative of the various ways in which the principles of the invention may be employed.

BRIEF DESCRIPTION OF THE DRAWINGS

For a better understanding of the invention, reference may be had to the preferred embodiment shown in the following drawings in which.

DETAILED DESCRIPTION

Figure 1:
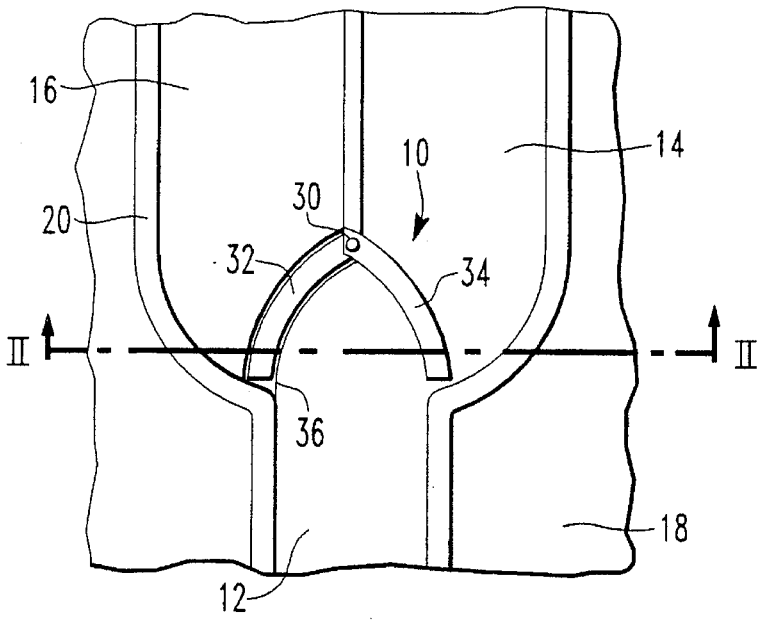
FIG. 1 illustrates a top view of the ball diverter mechanism which is the subject of the present invention.
Figure 2:
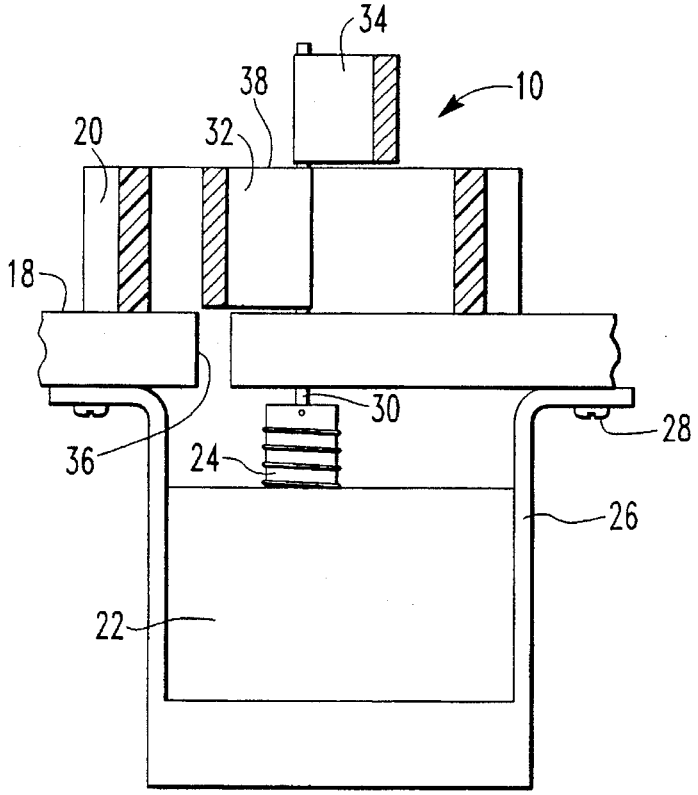
FIG. 2 illustrates a cross-sectional view along line II—II of FIG. 1 with the ball diverter mechanism of FIG. 1 being positioned in the extended position.
Figure 3:
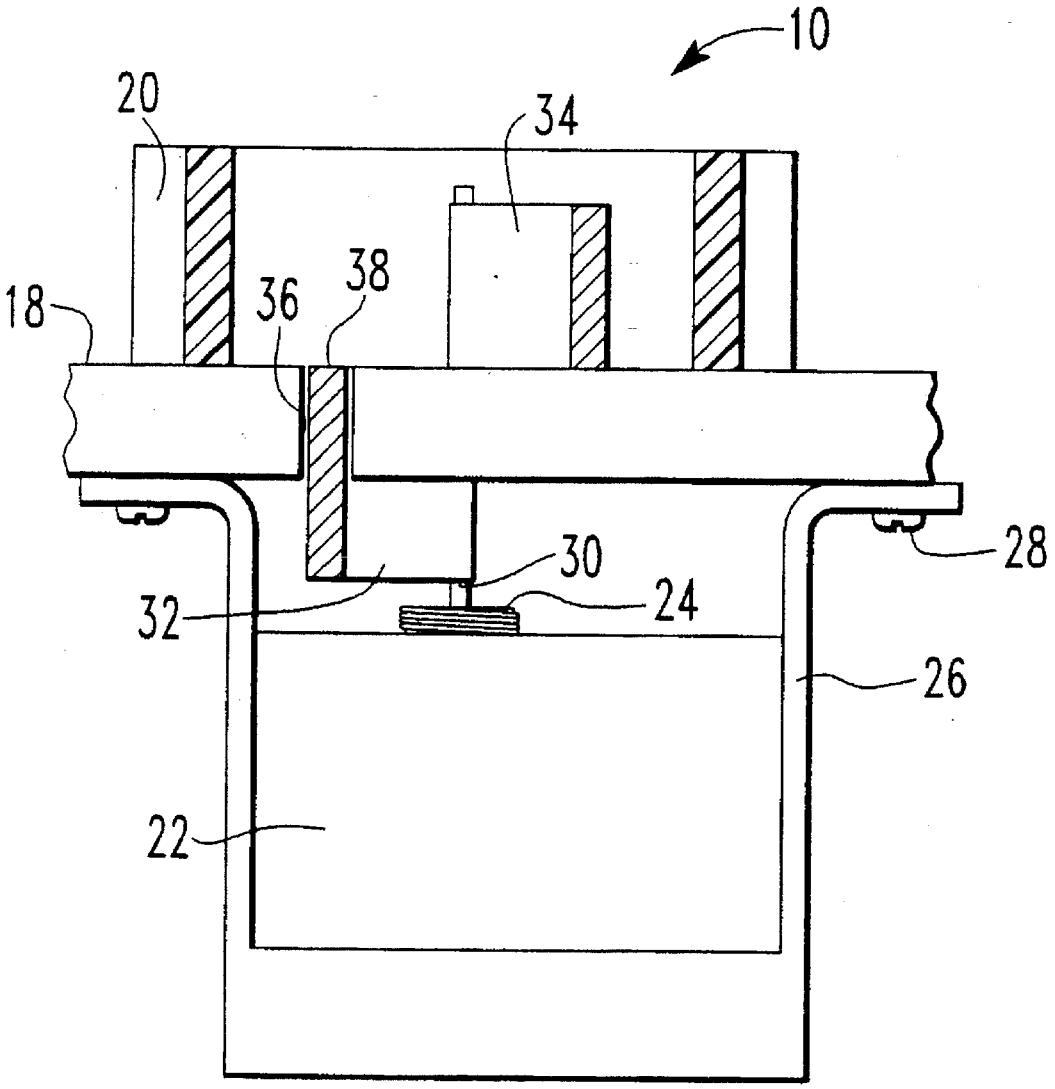
FIG. 3 illustrates a cross-sectional view along line II—II of FIG. 1 with the ball diverter mechanism of FIG. 1 being positioned in the retracted position.

While the invention can be used in conjunction with any amusement device having a moving play object it will be described hereinafter in the context of a pinball game as the preferred embodiment thereof.

Referring now to the figures, wherein like reference numerals refer to like elements, there is shown generally in the figures a ball diverter mechanism 10. As will be described hereinafter, the ball diverter mechanism 10 is used to direct a pinball from an entry path 12 into either a first exit path 14 or a second exit path 16. In the illustrated embodiment, both the first exit path 14 and the second exit path 16 are offset from the entry path 12 although it will be appreciated by those skilled in the art that the invention may be utilized with the paths in any configuration. The paths 12,14,16 may be created on the playfield surface 18 in a known manner by providing a molded plastic trough 20, wire form guides, or the like type of side wall surfaces.

The ball diverter mechanism 10 includes a vertically positioned solenoid 22 having a spring biased plunger 24 which is movable in a known manner between a first position and a second position. In the first position, the solenoid 22 is not activated and the plunger 24 is extended as a result of the spring bias. In the second position, the solenoid 22 is caused to be activated and the plunger 24 is retracted as a result of the electromagnetic force applied thereto by an electric current passing through the solenoid 22. The solenoid 22 may be mounted to the underside of the playfield in a known manner through the use of, for example, a bracket 26 attached to the underside of the playfield by screws 28.

Attached to the plunger 24 is a post 30 which extends upward through an opening in the playfield and is linearly movable therethrough in a plane substantially transverse to the plane of the playfield. The post 30 has attached thereto a first ball directing surface 32 and a second ball directing surface 34. In the illustrated embodiment, the first and second ball directing surfaces 32,34 are constructed from sheets of metal or the like and are attached by solder to the pole 30. The surfaces 32,34 are preferably arcuately shaped in order to provide a smooth directing surface from the entry path 12 to the exit paths 14,16. It is to be noted, however, that the ball directing surfaces 32,34 could also be constructed from wire form which would be, in turn, fixedly attached to the pole 30. It is also contemplated that the pole 30 and the two ball directing surfaces 32,34 could be of integral construction, for example, by being molded from plastic. Furthermore, it is desired that the second ball directing surface 34 be positioned higher on pole 30 than the first ball directing surface 32.

In operation, when the solenoid 22 is not activated such that the plunger 24 is extended, the first ball directing surface 32 will be positioned above the playing surface 18 such that any ball traveling down the entry path 12 will make contact therewith. Furthermore, the second ball directing surface 34 will be positioned higher above the playing surface 18 than the first ball directing surface 32 such that any ball traveling down the entry path 12 will not be able to make contact therewith. Therefore, a ball traveling down the entry path 12 will strike the first ball directing surface 32 and will thereafter travel under the second ball directing surface 34 as it is directed into the first exit path 14.

When the solenoid 24 is activated such that the plunger 24 is retracted, the first ball diverting surface 32 will follow the pole 30 downward into an opening 36 in the playfield such that any ball traveling down entry path 12 will not be able to make contact therewith. Meanwhile, the second ball diverting surface 34 will follow the pole 30 downward and will become positioned above the playfield surface 18 such that any ball traveling down the entry path 12 will make contact therewith. Therefore, a ball traveling down the entry path 12 will strike the second ball directing surface 34 and will thereafter travel over the first ball directing surface 32 as it is directed into the second path 16. The top surface 38 of the upper portion of the first ball directing surface 32 preferably becomes positioned substantially co-planar with the playfield surface 18 for supporting the pinball as the pinball passes thereover.

It should be apparent from the preceding description that this invention has among other advantages, the advantage of providing a ball diverter mechanism which utilizes a minimum of space under the playfield.

While specific embodiments of the invention have been described in detail, it will be appreciated by those skilled in the are that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any equivalent thereof.

We claim:

1. A ball diverter mechanism for use in directing a ball in a pinball game having a playfield including an entry path and first and second exit paths, said ball diverter mechanism comprising:

a solenoid having a plunger movable between a first position and a second position;

a first ball directing surface linked to said plunger; and a second ball directing surface linked to said plunger;

wherein said ball will engage said first ball directing surface and miss said second ball directing surface by traveling thereunder when said plunger is in said first position whereby said ball will be diverted from said entry path to said first exit path; and wherein said ball will engage said second ball directing surface and miss said first ball directing surface by traveling thereover when said plunger is in said second position whereby said ball will be diverted from said entry path to said second exit path.

2. The ball diverting mechanism as recited in claim 1, wherein said first ball directing surface and said second ball directing surface are generally arcuate in shape.

3. The ball diverting mechanism as recited in claim 1, wherein said solenoid is to be mounted under said playfield and a pole links said plunger to said first ball directing surface and said second ball directing surface.

4. A ball diverter mechanism for use in directing a ball in a pinball game having a playfield including an entry path and first and second exit paths, said ball diverter mechanism comprising:

a solenoid having a plunger movable between a first position and a second position;

a pole connected to said plunger and linearly movable in a plane substantially transverse to the plane occupied by said playfield in response to the movement of said plunger;

a generally arcuate, first ball directing surface mounted to said pole; and a generally arcuate, second ball directing surface mounted to said pole and positioned above said first ball directing surface;

wherein said ball will engage said first ball directing surface and miss said second ball directing surface by traveling thereunder when said plunger is in said first position whereby said ball will be diverted from said entry path to said first exit path; and wherein said ball will engage said second ball directing surface and miss said first ball directing surface by traveling thereover when said plunger is in said second position whereby said ball will be diverted from said entry path to said second exit path.

5. A pinball machine, comprising;

a playfield surface having a pole opening and a surface opening;

a ball movable upon said playfiled surface;

a ball guide mounted to said playfield surface and having an entry path and first and second exit paths offset from said entry path;

a solenoid mounted under said playfield surface having a plunger movable between an extended first position and a retracted second position;

a pole connected to said plunger through said opening and extending into said ball guide between said entry path and said first and second exit paths, said pole being movable in a plane substantially transverse to the plane occupied by said playfield in response to the movement of said plunger; and generally arcuate first and second ball directing surfaces mounted to said pole;

wherein said ball will engage said first ball directing surface and miss said second ball directing surface by traveling thereunder when said plunger is in said first position whereby said ball will be diverted from said entry path to said first exit path; and wherein said ball will engage said second ball directing surface and miss said first ball directing surface by traveling thereover as said first ball directing surface is positioned within said surface opening when said plunger is in said second position whereby said ball will be diverted from said entry path to said second exit path.

* * * * *